US007237407B2

(12) United States Patent
Paradowski

(10) Patent No.: US 7,237,407 B2
(45) Date of Patent: Jul. 3, 2007

(54) PROCESS AND PLANT FOR THE SIMULTANEOUS PRODUCTION OF AN LIQUEFIABLE NATURAL GAS AND A CUT OF NATURAL GAS LIQUIDS

(75) Inventor: Henri Paradowski, Cergy (FR)

(73) Assignee: Technip France (FR)

( * ) Notice: Subject to any disclaimer, the term of this patent is extended or adjusted under 35 U.S.C. 154(b) by 416 days.

(21) Appl. No.: 10/860,689

(22) Filed: Jun. 2, 2004

(65) Prior Publication Data

US 2004/0244415 A1 Dec. 9, 2004

(30) Foreign Application Priority Data

Jun. 2, 2003 (FR) ..... 03 06632

(51) Int. Cl.
*F25J 3/00* (2006.01)

(52) U.S. Cl. ..... 62/620; 62/611; 62/617; 62/618; 62/630; 62/613; 62/619

(58) Field of Classification Search ..... 62/612, 62/611, 620, 617, 618, 630, 635, 619, 613
See application file for complete search history.

(56) References Cited

U.S. PATENT DOCUMENTS 3,440,828 A * 4/1969 Bolez et al. ..... 62/612
4,456,461 A 6/1984 Perez
5,325,673 A * 7/1994 Durr et al. ..... 62/634
6,354,105 B1 * 3/2002 Lee et al. ..... 62/619
6,539,747 B2 * 4/2003 Minta et al. ..... 62/620
6,742,358 B2 * 6/2004 Wilkinson et al. ..... 62/613
2003/0005722 A1 1/2003 Wilkinson et al.

OTHER PUBLICATIONS

Chiu, C-H: : "LPG-recovery processes for baseload LNG plants examined" Oil and Gas Journal, Pennwell Publishing Co. Tulsa US Nov. 24, 1997, pp. 59-63, XP001093790, ISSN: 0030-1388, the entire document.

* cited by examiner

*Primary Examiner*—Cheryl Tyler
*Assistant Examiner*—John Pettitt
(74) *Attorney, Agent, or Firm*—Ostrolenk, Faber, Gerb & Soffen, LLP

(57) ABSTRACT

This process includes the following steps:

(a) the feed natural gas (101) is introduced into a first distillation column (31) which produces, as top product, a pretreated natural gas (111), which pretreated natural gas (111) no longer contains practically any $C_6^+$ hydrocarbons;

(b) the pretreated natural gas (111) is introduced into an NGL recovery unit (19) comprising at least a second distillation column (49), so as to produce, on the one hand, as column top product, a purified natural gas (151) and, on the other hand, an NGL cut (15); and (c) the said liquefiable natural gas (161) is formed from the purified natural gas (151) resulting from step (b).

12 Claims, 1 Drawing Sheet

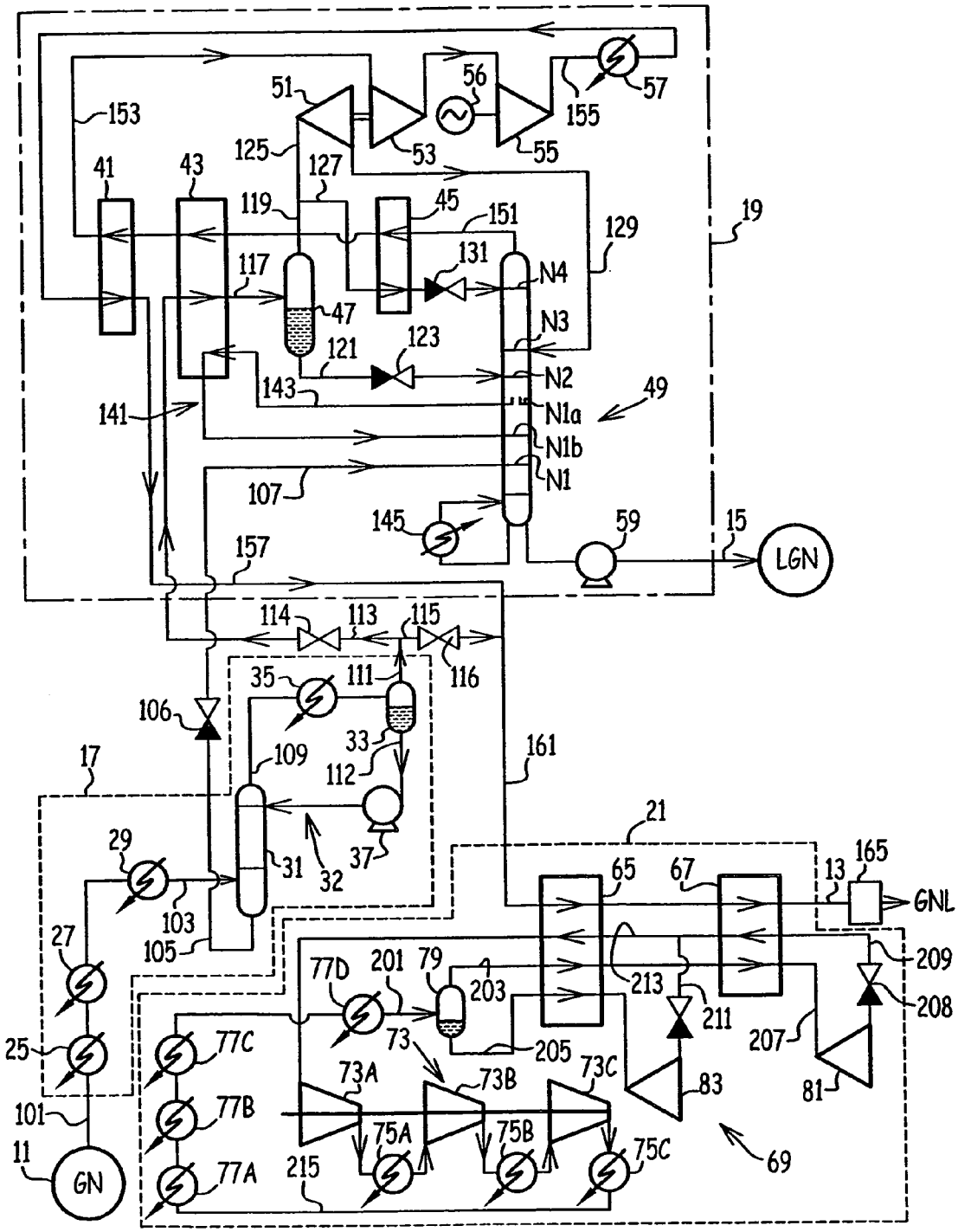
51
56
57
153
155
53
55
125
127
41
43
119
45
151
129
19
117
131
N4
47
N3
121
123
143
N2
49
141
N1a
N1b
N1
107
145
59
15
LGN
157
114
113
115
116
35
111
106
33
17
109
112
161
21
29
31
32
37
65
67
13
165
GNL
103
27
105
209
77D
201
79
203
213
211
208
207
25
77C
73
205
73A
73B
73C
83
81
101
77B
75A
75B
75C
11
GN
77A
215
69

PROCESS AND PLANT FOR THE SIMULTANEOUS PRODUCTION OF AN LIQUEFIABLE NATURAL GAS AND A CUT OF NATURAL GAS LIQUIDS

BACKGROUND OF THE INVENTION

The present invention relates to a process for the simultaneous production of a liquefiable natural gas and a natural gas liquids (NGL) cut from a feed natural gas containing nitrogen, methane, $C_2$ to $C_5$ hydrocarbons and $C_6^+$ heavy hydrocarbons, of the type comprising the following steps:

(a) the said feed natural gas is pretreated in order to obtain a pretreated natural gas;

(b) the pretreated natural gas resulting from step (a) is cooled down to a temperature close to its dew point;

(c) the cooled pretreated natural gas resulting from step (b) is expanded and the expanded natural gas is introduced into an NGL recovery unit comprising at least one main distillation column so as to produce, on the one hand, as column top product, a purified natural gas and, on the other hand, the said NGL cut; and (d) the said liquefiable natural gas is formed from the purified natural gas resulting from step (c).

The process of the present invention applies to plants for producing, from a natural gas extracted from under the ground, liquid natural gas (termed an "LNG") as main product and a cut of natural gas liquids (that will be termed "NGL") as by-product.

In the present invention, NGL is understood to mean $C_2^+$ to $C_3^+$ hydrocarbons that can be extracted from natural gas. By way of example, these NGLs may comprise ethane, propane, butane and $C_5^+$ hydrocarbons.

The LNG produced after extraction of the NGLs possesses a lower calorific value than an LNG produced without extraction of the NGLs.

Known natural gas liquefaction plants comprise, in succession, a unit for producing a liquefiable gas, a unit for the actual liquefaction, and a unit for removing nitrogen from the LNG. The unit for producing a liquefiable gas necessarily comprises means for removing the $C_6^+$ heavy hydrocarbons that may crystallize during liquefaction.

To produce liquefiable natural gas and NGLs simultaneously, it is possible to use, for example, a process of the aforementioned type, such as that described in Application FR-A-2 817 766.

Such a process has a thermodynamic efficiency optimized for producing a natural gas at room temperature and for NGL extraction.

Consequently, this process is not entirely satisfactory if the natural gas obtained has to be liquefied. This is because the energy expenditure needed to liquefy the natural gas obtained is relatively high.

SUMMARY OF THE INVENTION

The main object of the invention is to remedy this drawback, that is to say to provide a process for the simultaneous production of LNG and an NGL cut that is more economical and more flexible than the existing processes.

For this purpose, the subject of the invention is a process of the aforementioned type, characterized in that step (a) comprises the following substeps:

(a1) the feed natural gas is cooled down to a temperature close to its dew point;

(a2) the said cooled feed natural gas resulting from step (a1) is introduced into an auxiliary distillation column that produces, as top product, the said pretreated natural gas, which pretreated natural gas no longer contains practically any $C_6^+$ hydrocarbons, this first auxiliary distillation column furthermore producing a cut of essentially $C_6^+$ heavy hydrocarbons.

The process according to the invention may include one or more of the following features, taken individually or in any possible combination:

step (d) comprises the following substeps:

(d1) the purified natural gas extracted from the top of the said main column is compressed at a liquefaction pressure in at least a first compressor; and (d2) the compressed purified natural gas resulting from step (d1) is cooled, by heat exchange with the said purified natural gas extracted from the top of the main column, in a first heat exchanger in order to produce the liquefiable natural gas;

step (b) comprises the following substep:

(b1) the pretreated natural gas resulting from step (a) is cooled by heat exchange with the purified natural gas extracted from the second main column in a second heat exchanger;

step (c) comprises the following substeps:

(c1) the cooled pretreated natural gas resulting from step (b) is introduced into a separation drum in order to obtain a liquid stream and a gas stream;

(c2) the gas stream resulting from step (c1) is expanded in a turbine coupled to a first compressor;

(c3) the stream resulting from step (c2) is introduced into the main column at an intermediate level N3; and (c4) the liquid stream resulting from step (c1) is expanded and this expanded liquid stream is introduced into the main column at a level N2 below the level N3;

in step (d1), the compressed purified natural gas output by the first compressor is compressed in a second compressor supplied by an external energy source in order to reach the said liquefaction pressure;

the pressure of the main distillation column is greater than 35 bar;

the liquefiable natural gas furthermore includes a portion of the pretreated natural gas coming directly from step (a);

the process includes a start-up phase in which the liquefiable natural gas consists mostly or completely of the pretreated natural gas coming directly from step (a), the said liquefiable natural gas being relatively enriched with $C_2$ to $C_5$ hydrocarbons, and the process includes a subsequent production phase in which the portion of pretreated natural gas coming directly from step (a) in the liquefiable natural gas is adjusted according to the desired $C_2$ to $C_5$ hydrocarbon content in the liquefiable natural gas; and a liquid produced by the auxiliary column is expanded and introduced into the main column.

The subject of the invention is also a plant for the simultaneous production of a liquefiable natural gas and a natural gas liquids (NGL) cut from a feed natural gas containing nitrogen, methane, $C_2$ to $C_5$ hydrocarbons and $C_6^+$ heavy hydrocarbons, of the type comprising:

(a) a unit for pretreatment of the said feed natural gas in order to obtain a pretreated natural gas;

(b) means for cooling the pretreated natural gas down to a temperature close to its dew point;

(c) a unit for recovering the NGLs, comprising means for expanding the cooled pretreated natural gas and comprising at least one main distillation column which produces, on the one hand, as column top product, a purified natural gas and, on the other hand, the said NGL cut; and (d) means for sending the purified natural gas resulting from step (c) into a liquefiable natural gas line;

characterized in that the pretreatment unit comprises:

(a1) means for cooling the feed natural gas down to a temperature close to its dew point; and (a2) an auxiliary distillation column for distilling the cooled feed natural gas, which produces, as top product, the said pretreated natural gas, which no longer contains practically any $C_6^+$ hydrocarbons, this auxiliary column furthermore producing a cut of essentially $C_6^+$ heavy hydrocarbons.

The plant according to the invention may include one or more of the following features, taken individually or in any possible combination:

the means for forming the liquefiable natural gas comprise:

(d1) means for compressing the purified natural gas extracted from the top of the main column at a liquefaction pressure, comprising at least a first compressor; and (d2) a first heat exchanger which brings the compressed purified natural gas coming from the said compression means into heat-exchange relationship with the said purified natural gas extracted from the top of the main column, the said compressed purified natural gas being cooled in this first exchanger in order to produce the liquefiable natural gas;

the means for cooling the pretreated natural gas comprise a second heat exchanger which brings this gas into heat-exchange relationship with the said purified natural gas extracted from the main column;

the unit for recovering the NGLs comprises:

(c1) a separation drum for separating the cooled pretreated natural gas, which drum produces a liquid stream and a gas stream;

(c2) a first expansion turbine for expanding the said gas stream, the said turbine being coupled to the said first compressor;

(c3) means for introducing the expanded gas stream into the main column at an intermediate level N3; and (c4) means for expanding the said liquid stream and means for introducing the expanded liquid stream into the main column at a level N2 below N3;

the means for compressing the purified natural gas extracted from the top of the main column furthermore comprise a second compressor driven by an external energy source and intended to increase the pressure of the compressed purified natural gas up to the liquefaction pressure; and the means for forming the purified natural gas comprise means for selectively introducing an adjustable portion of the pretreated natural gas coming directly from the pretreatment unit into a liquefiable natural gas line.

BRIEF DESCRIPTION OF THE DRAWING

An example of how the invention may be implemented will now be described in conjunction with the single appended FIGURE, which shows a block diagram illustrating the operation of a plant according to the invention.

DESCRIPTION OF A PREFERRED EMBODIMENT

The plant shown in the FIGURE relates to the simultaneous production, from a source 11 of dry, decarbonated and desulphurized, feed natural gas, of LNG 13 as main product and of an NGL cut 15 as by-product. This plant includes a unit 17 for removing the $C_6^+$ heavy hydrocarbons, a unit 19 for recovering the NGLs and a liquefaction unit 21.

Hereafter, a stream of liquid and the line that conveys it will both be denoted by the same reference, and the pressures in question are absolute pressures.

The unit 17 for removing the heavy hydrocarbons comprises, in succession, downstream of the source 11, first, second and third coolers 25, 27, 29 and a first distillation column, or auxiliary distillation column 31 fitted with an overhead condenser 32. This condenser comprises, between the top of the first column 31 and a first separation drum 33 a fourth cooler 35 on one side, and a reflux pump 37 on the other.

The NGL recovery unit 19 comprises first, second and third heat exchangers 41, 43, 45, a second separation drum 47, a second distillation column, or main distillation column 49, a first turbine 51 coupled to a first compressor 53, a second compressor 55 driven by an external energy source 56, a fifth cooler 57 and an NGL extraction pump 59.

The natural gas liquefaction unit 21 includes fourth and fifth heat exchangers 65, 67 that are cooled by a refrigeration cycle 69.

This cycle 69 comprises a compressor 73 with three stages 73A, 73B, 73C, the said compressor being provided with first and second intercoolers 75A and 75B and with an aftercooler 75C, four coolers 77A to 77D in series, a third separation drum 79 and first and second hydraulic turbines 81 and 83.

An example of how the process according to the invention is implemented will now be described.

The initial molar composition of the stream 101 of dry, decarbonated and desulphurized, feed natural gas contains 3.90% nitrogen, 87.03% methane, 5.50% ethane, 2.00% propane, 0.34% isobutane, 0.54% n-butane, 0.18% isopentane, 0.15% n-pentane, 0.31% $C_6$ hydrocarbons, 0.03% $C_7$ hydrocarbons and 0.02% $C_8$ hydrocarbons.

This gas 101 is successively cooled in the first, second and third coolers 25, 27, 29 in order to form the cooled feed natural gas 103. This gas 103 is then introduced into the distillation column 31.

This column 31 produces, as bottom product, a cut 105 of $C_6^+$ heavy hydrocarbons. This cut 105 is expanded in an expansion valve 106 in order to produce an expanded stream 107 of heavy hydrocarbons, which is introduced into the second distillation column 49 at a low level N1.

Moreover, the first column 31 produces, as top product, a stream 109 of pretreated gas. This stream 109 is cooled and partially condensed in the fourth cooler 35 and then introduced into the first separation drum 33, where the separation between a gas phase constituting the pretreated natural gas 111 and a liquid phase constituting a reflux liquid 112 is performed, the said liquid being returned as reflux into the purification column by the reflux pump 37.

The molar composition of the pretreated gas stream 111 contains 3.9783% nitrogen, 88.2036% methane, 5.3622% ethane, 1.7550% propane, 0.2488% isobutane, 0.3465% n-butane, 0.0616% isopentane, 0.0384% n-pentane and 0.0057% $C_6$ hydrocarbons.

The $C_6^+$ hydrocarbons have been substantially removed from this stream 111.

The pretreated natural gas stream 111 is then divided into a stream 113 that feeds the NGL recovery unit 19 and a stream 115 that feeds the gas liquefaction unit 21. The division between these two streams is chosen by controlling two respective control valves 114 and 116.

The stream 113 introduced into the recovery unit 19 is cooled in the second heat exchanger 43 in order to give a two-phase stream 117 of cooled pretreated natural gas. This stream 117 is introduced into the second separation drum 47, which produces a vapour stream 119 and a liquid stream 121. The liquid stream 121 is expanded in an expansion valve 123 and then introduced into the column 49 at a level N2 above the level N1.

The vapour stream 119 is separated into a major fraction 125 and a minor fraction 127.

The major fraction 125 is expanded in the turbine 51 in order to give an expanded main fraction 129, which is introduced into the column 49 at a level N3 above the level N2.

The minor fraction 127 is cooled in the third heat exchanger 45, expanded in an expansion valve 131 and then introduced into the distillation column 49 at a high level N4. The level N4 is above the level N3.

The column 49 is also equipped with an intermediate reboiler 141. A reboiler stream 143 is extracted from this column at a level N1*a* below N2 and above N1. This stream is warmed in the second heat exchanger 43 and reintroduced into the second column 49 at a level N1*b* between the level N1*a* and the level N1.

The NGL cut 15 is extracted from the bottom of the distillation column 49 by the pump 59. Furthermore, a bottom reboiler 145 is mounted on the column 49 in order to adjust the molar ratio of $C_1$ hydrocarbons relative to the $C_2$ hydrocarbons of the NGL cut 15. This ratio is preferably less than 0.02.

Thus, this NGL cut 15 contains 0.3688% methane, 36.8810% ethane, 33.8344% propane, 6.1957% isobutane, 9.9267% n-butane, 3.3354% isopentane, 2.7808% n-pentane, 5.7498% $C_6$ hydrocarbons, 0.5564% $C_7$ hydrocarbons and 0.3710% $C_8$ hydrocarbons.

The respective levels of ethane, propane and $C_4^+$ hydrocarbon extraction are 36.15%, 91.21% and 99.3%. Thus, the level of ethane recovery by the process according to the invention is greater than 30%. The level of propane recovery is greater than 80% and preferably greater than 90%. The level of $C_4^+$ hydrocarbon recovery is greater than 90% and preferably greater than 95%.

A stream 151 of purified natural gas is extracted as top product from the column 49. This stream 151 is warmed successively in the heat exchanger 45, in the heat exchanger 43 and then in the heat exchanger 41. It should be pointed out that no external cold source is needed for the NGL recovery unit 19 to operate.

The warmed gas stream 1-53 coming from the exchanger 41 is then compressed successively in the first compressor 51 and then in the second compressor 55 in order to produce a gas stream 155 at the liquefaction pressure.

This stream 155 is cooled in the fifth cooler 57 and then in the first heat exchanger 41 in order to give a stream 157 of cooled purified gas. The stream 157 is mixed with the stream 115 that feeds the gas liquefaction unit, extracted from the unit 17 for removing the $C_6^+$ heavy hydrocarbons. This stream 157 and this stream 115 have substantially the same temperatures and pressures and form the stream 161 of liquefiable natural gas.

The molar composition of this stream 161 of liquefiable natural gas contains 4.1221% nitrogen, 91.9686% methane, 3.7118% ethane, 0.1858% propane, 0.0063% isobutane, 0.0051% n-butane and 0.0003% $C_5^+$ hydrocarbons.

The stream 161 of liquefiable natural gas is then cooled successively in the fourth and fifth heat exchangers 65, 67 in order to produce the LNG stream 13. This LNG stream 13 then undergoes a nitrogen removal step operation in a unit 165.

The refrigeration in the fourth and fifth heat exchangers 65, 67 is provided by a stream 201 of a refrigerant mixture. This stream 201, partially liquefied in the fourth cooler 77D, is introduced into the separation drum 71 and separated into a vapour phase 201 and a liquid phase 203.

The molar compositions of this stream 201 and of the liquid and vapour phases 203 and 205 are the following:

| | Stream 201 (%) | Stream 203 (%) | Stream 205 (%) |
|---|---|---|---|
| N2 | 4.0 | 10.18 | 1.94 |
| C1 | 42.4 | 67.90 | 33.90 |
| C2 | 42.6 | 20.18 | 50.07 |
| C3 | 11.0 | 1.74 | 14.09 |

The vapour phase 203 is liquefied in the heat exchanger 65 in order to give a liquid stream that is then subcooled in the fifth heat exchanger 67 to give a subcooled liquid stream 207.

This subcooled liquid stream 207 is expanded in the first hydraulic turbine 81 and then in an expansion valve 208, in order to give a first refrigerant stream 209. This stream 209 vaporizes in the heat exchanger 67 and allows the gas 161 to liquefy.

The liquid phase 205 is subcooled in the exchanger 65 to give a subcooled stream which, in turn, is expanded in the second hydraulic turbine 83 and then in an expansion valve 210, in order to give a second refrigerant stream 211. The streams 209 and 211 are mixed to give a combined stream 213 which is vaporized in the exchanger 65. This vaporization cools the stream 161 and condenses the vapour phase 203 of the refrigerant mixture stream 201. The mixture stream 213 is then compressed in the compressor 77, the characteristics of which are given in the table below, in order to obtain a compressed mixture stream 215.

| Compressor | 73A | 73B | 73C |
|---|---|---|---|
| Suction temperature (° C.) | −37.44 | 34 | 34 |
| Discharge temperature (° C.) | 67.25 | 68.70 | 68.15 |
| Suction pressure (bar) | 3.65 | 18.30 | 29.70 |
| Discharge pressure (bar) | 18.70 | 30.00 | 47.61 |
| Polytropic efficiency (%) | 82 | 82 | 82 |
| Power (kW) | 74109 | 24396 | 21882 |

This compressed mixture stream 215 is then successively cooled in the four series-connected coolers 81 in order to form the stream 201.

The first, second, third and fourth coolers 25, 27, 29, 35 for cooling the feed natural gas on the one hand, and the four coolers 77A to 77D for cooling the mixture stream 201 on the other, use the same propane refrigerating cycle (not shown). This cycle comprises the four following vaporization stages: 6.7° C./7.92 bar; 0° C./4.76 bar; −20° C./2.44 bar; −36° C./1.30 bar.

Modelling of the temperatures, pressures and flow rates of the plant operating as shown in the FIGURE is given by way of example in the table below.

| Stream | Temperature (° C.) | Pressure (bar) | Flow rate (kg/h) |
|---|---|---|---|
| 13 | −148 | 58.9 | 809567 |
| 15 | 78 | 43.2 | 123436 |
| 101 | 23 | 62.0 | 933003 |
| 103 | −18 | 61.1 | 933003 |
| 105 | −18 | 61.1 | 49888 |
| 107 | −23 | 39.8 | 49888 |
| 111 | −34 | 60.8 | 883115 |
| 113 | −34 | 60.8 | 883115 |
| 115 | — | — | 0 |
| 117 | −47 | 60.1 | 883115 |
| 123 | −59 | 39.8 | 36469 |
| 129 | −66 | 39.8 | 675718 |
| 131 | −86 | 39.8 | 178092 |
| 143 | −48 | 39.6 | 124894 |
| 151 | −76 | 39.5 | 809567 |
| 153 | 32 | 38.8 | 809567 |
| 155 | 74 | 61.5 | 809567 |
| 157 | −34.6 | 60.1 | 809567 |
| 161 | −34.6 | 60.1 | 809567 |
| 201 | −34 | 46.1 | 1510738 |
| 207 | −148 | 44.9 | 303816 |
| 209 | −154 | 4.2 | 303816 |
| 211 | −130 | 4.1 | 1206922 |
| 213 | −128 | 4.1 | 1510738 |
| 215 | 34 | 47.6 | 1510738 |

As illustrated in this example, the pressure of the distillation column 31 is preferably between 45 and 65 bar. The pressure in the second column is preferably greater than 35 bar.

It is thus possible to optimize the operation of each of the columns in order to favour, on the one hand, the extraction of $C_6^+$ hydrocarbons in the column 31 and, on the other hand, the extraction of ethane and propane in the column 49.

Moreover, the purified gas stream 157 and the stream that feeds the gas liquefaction unit 115 are produced at a pressure above 55 bar.

This process thus makes it possible to achieve energy savings as illustrated in the table below, in which the consumed powers in a prior art plant that does not have an auxiliary column 31 and in a plant according to the invention are compared.

More precisely, in the prior art plant, the stream of feed natural gas 101 is sent directly into the NGL extraction unit 19 and the coolers 25, 27, 29 and 35 that use the propane cycle also serve to precool the gas stream at the liquefaction pressure 155, unlike the plant according to the invention in which the exchanger 41 is used to perform this precooling.

| | Prior art process | Process according to the invention |
|---|---|---|
| Mixed refrigerant compressor 73 (kW) | 119460 | 120387 |
| Propane refrigerant compressor (not shown) (kW) | 69700 | 72174 |
| Treated gas compressor 55 (kW) | 20650 | 14964 |
| Total (kW) | 209810 | 207525 |

Thus, the plant according to the invention makes it possible to produce simultaneously LNG 13 and an NGL cut 15 with, compared with the prior art plant, a saving of 2285 kW.

Moreover, when starting up the plant according to the invention, all of the pretreated natural gas stream 111 coming from the unit 17 for removing the heavy hydrocarbons is sent, via the feed stream 115, directly into the liquefaction unit 21. The LNG produced therefore has a relatively high calorific value. The NGL recovery unit 19 is then progressively started up, without affecting the productivity of the liquefaction unit 21. The calorific value of the LNG produced is then adjusted by the relative flow rates of the feed streams 113 for the NGL recovery unit and 115 for the gas liquefaction unit.

Likewise, should an incident occur in the NGL recovery unit 19, all of the pretreated natural gas stream 111 coming from the heavy hydrocarbon removal unit 17 is sent, via the feed stream 115, directly into the liquefaction unit 21.

As a variant, the NGL recovery unit may include a third distillation column which is mounted downstream of the second distillation column and which operates at a lower or higher pressure than this second column. This third column is used to enrich the NGLs with a particular component, such as propane. An example of such a unit is disclosed in EP-A-0 535 752.

Thanks to the invention that has just been described, it is possible to have a plant that simultaneously produces LNG and NGLs in an economic and flexible manner, with high levels of extraction in the case of the $C_2$ to $C_5$ hydrocarbons. Surprisingly, the energy consumption is significantly reduced by inserting an auxiliary distillation column upstream of the NGL recovery unit and by introducing the top product fraction from this column into this unit.

The productivity of such a plant is increased by the possibility of directing at least a portion of this top product fraction directly into the liquefaction unit, especially during the plant start-up phases or in the event of a breakdown in the NGL recovery unit.

Moreover, this plant makes it possible to produce LNGs of adjustable calorific value.

The invention claimed is:

1. Process for simultaneous production of a liquefiable natural gas and a natural gas liquids (NGL) cut from a feed natural gas containing nitrogen, methane, $C_2$ to $C_5$ hydrocarbons and $C_6^+$ heavy hydrocarbons;

the method comprising the following steps:

(a) pretreating said feed natural gas in order to obtain a pretreated natural gas;

(b) cooling the pretreated natural gas resulting from step (a) to a temperature close to its dew point;

(c) expanding the cooled pretreated natural gas resulting from step (b) and introducing the expanded natural gas into an NGL recovery unit comprising at least one main distillation column and therein producing, on the one hand, as column top product, a purified natural gas and, on the other hand, said NGL cut; and (d) forming the liquefiable natural gas from the purified natural gas resulting from step (c):

wherein step (a) comprises the following substeps:

(a1) cooling the feed natural gas to a temperature close to its dew point;

(a2) introducing said cooled feed natural gas resulting from step (a1) into an auxiliary distillation column equipped with an overhead condenser that produces a reflux, operating the auxiliary distillation column at a pressure between 45 and 65 bar and producing, as top product, said pretreated natural gas, wherein the pretreated natural gas no longer contains practically any $C_6^+$ hydrocarbons, the auxiliary distillation column furthermore producing a cut of essentially $C_6^+$ heavy hydrocarbons;

wherein step (c) comprises the following substeps:

(c1) introducing the cooled pretreated natural gas resulting from step (b) into a separation drum in order to obtain a liquid stream and a gas stream;

(c2) expanding the gas stream resulting from step (c1) in a turbine coupled to a first compressor;

(c3) introducing the stream resulting from step (c2) into the main column at an intermediate level; and (c4) expanding the liquid stream resulting from step (c1) and introducing this expanded liquid stream into the main column at a lower level below the intermediate level;

and the liquefiable natural gas furthermore includes a portion of the pretreated natural gas coming directly from step (a), and wherein said process further comprises a start-up phase in which the liquefiable natural gas consists mostly or completely of the pretreated natural gas coming directly from step (a), said liquefiable natural gas being relatively enriched with $C_2$ to $C_5$ hydrocarbons, and a subsequent production phase of adjusting the portion of pretreated natural gas coming directly from step (a) in the liquefiable natural gas and adjusting it according to the desired $C_2$ to $C_5$ hydrocarbon content in the liquefiable natural gas.

2. Process according to claim 1, wherein step (d) comprises the following substeps:

(d1) extracting the purified natural gas from the top of the said main column and compressing the extracted gas at a liquefaction pressure in at least the first compressor; and (d2) cooling the compressed purified natural gas resulting from step (d1) by heat exchange with said purified natural gas extracted from the top of the main column, in a first heat exchanger in order to produce the liquefiable natural gas.

3. Process according to claim 2, wherein step (b) comprises the following substep:

(b1) cooling the pretreated natural gas resulting from step (a) by heat exchange with the purified natural gas extracted from the main distillation column in a second heat exchanger.

4. Process according to claim 2, wherein in step (d1), compressing the compressed purified natural gas output by the first compressor in a second compressor supplied by an external energy source order to reach the liquefaction pressure.

5. Process according to claim 1, wherein the pressure of the main distillation column is greater than 35 bar.

6. Process according to claim 1, wherein a liquid is produced by the auxiliary column and the process comprises expanding and introducing the liquid into the main column.

7. Process according to claim 1, wherein the auxiliary distillation column is designed to extract approximately 98 mol % of $C_6^+$ hydrocarbons present in the feed natural gas.

8. Process according to claim 1, wherein the molar content of $C_6^+$ hydrocarbons in the pretreated natural gas is approximately 57 ppm.

9. Plant for the simultaneous production of a liquefiable natural gas and a natural gas liquids (NGL) cut from a feed natural gas containing nitrogen, methane, $C_2$ to $C_5$ hydrocarbons and $C_6^+$ heavy hydrocarbons, the plant comprising:

(a) a pretreatment unit for pretreatment of said feed natural gas in order to obtain a pretreated natural gas;

(b) a first cooling unit for cooling the pretreated natural gas to a temperature close to its dew point;

(c) a recovering unit for recovering the NGLs and comprising an expanding device for expanding the cooled pretreated natural gas and comprising at least one main distillation column which produces, on the one hand, as column top product, a purified natural gas and, on the other hand, said NGL cut; and (d) a forming device operable for forming the liquefiable natural gas from the purified natural gas resulting from the recovery unit;

(a) pretreatment unit comprises:

(a1) a second cooling unit for cooling the feed natural gas to a temperature close to its dew point; and (a2) an auxiliary distillation column for distilling the cooled feed natural gas, said auxiliary distillation column is equipped with an overhead condenser producing a reflux, said auxiliary distillation column operating at a pressure between 45 and 65 bar and producing, as top product, said pretreated natural gas, which no longer contains practically any $C_6^+$ hydrocarbons, and said auxiliary column furthermore producing a cut of essentially $C_6^+$ heavy hydrocarbons;

said (c) recovering unit for recovering the NGLs comprises:

(c1) a separation drum for separating the cooled pretreated natural gas, said drum produces a liquid stream and a gas stream;

(c2) a first expansion turbine for expanding the gas stream, said turbine being coupled to a first compressor;

(c3) a conduit for introducing the expanded gas stream into the main column at an intermediate level; and (c4) an expanding unit for expanding said liquid stream and means for introducing the expanded liquid stream into the main column at a lower level below the intermediate level;

and the forming device operable for forming the liquefiable natural gas comprises an adjusting device for selectively introducing an adjustable portion of the pretreated natural gas coming directly from the pretreatment unit into the liquefiable natural gas line, and wherein, during a start-up phase of operation of said plant the liquefiable natural gas consists mostly or completely of the pretreated natural gas coming directly from said pretreatment unit, said liquefiable natural gas being relatively enriched with $C_2$ to $C_5$ hydrocarbons, and in a subsequent production phase, the portion of said pretreated natural gas, coming directly from said pretreatment unit, in the liquefiable natural gas is adjusted to achieve a desired $C_2$ to $C_5$ hydrocarbon content in said liquefiable natural gas.

10. Plant according to claim 9, wherein said forming device operable for forming the liquefiable natural gas comprises:

(d1) a compressing device for compressing the purified natural gas extracted from the top of the main column at a liquefaction pressure, and comprising at least the first compressor; and (d2) a first heat exchanger operable to bring the compressed purified natural gas coming from said compressing device into heat-exchange relationship with the purified natural gas extracted from the top of the main column, the compressed purified natural gas being cooled in said first exchanger in order to produce the liquefiable natural gas.

11. Plant according to claim 10, wherein said first cooling unit for cooling the pretreated natural gas comprises a second heat exchanger which brings the pretreated gas into heat-exchange relationship with said purified natural gas extracted from the main column.

12. Plant according to claim 10, wherein said compressing device for compressing the purified natural gas extracted from the top of the main column furthermore comprising a second compressor driven by an external energy source and intended to increase the pressure of the compressed purified natural gas up to the liquefaction pressure.

* * * * *

UNITED STATES PATENT AND TRADEMARK OFFICE

CERTIFICATE OF CORRECTION

PATENT NO. : 7,237,407 B2
APPLICATION NO. : 10/860689
DATED : July 3, 2007
INVENTOR(S) : Henri Paradowski It is certified that error appears in the above-identified patent and that said Letters Patent is hereby corrected as shown below:

On the title page replace the Assignee with the following:

(73) Assignee: Technip France (FR)
Total S.A. (FR)

Signed and Sealed this

Fourth Day of September, 2007

JON W. DUDAS
*Director of the United States Patent and Trademark Office*